United States Patent [19]

Getzin

[11] Patent Number: 4,526,591

[45] Date of Patent: Jul. 2, 1985

[54] ELECTRODE RAPPING ARRANGEMENT

[75] Inventor: Allan R. Getzin, Prospect, Ky.

[73] Assignee: Allis-Chalmers Corporation, Milwaukee, Wis.

[21] Appl. No.: 449,471

[22] Filed: Dec. 13, 1982

[51] Int. Cl.[3] ..... B03C 3/76

[52] U.S. Cl. ..... 55/112; 55/136; 55/156; 55/300

[58] Field of Search ..... 55/112, 300, 304, 136, 55/145, 156; 173/94, 99, 98, 96, 95, 90

[56] References Cited

U.S. PATENT DOCUMENTS

| | | | |
|---|---|---|---|
| 3,165,388 | 1/1965 | Jaderbrandt | 55/112 |
| 3,570,217 | 3/1971 | Steuernagel | 55/112 |
| 3,793,804 | 2/1974 | Steuernagel | 55/112 |
| 3,892,545 | 7/1975 | Goransson | 55/112 |
| 3,920,085 | 11/1975 | Bourke | 55/112 X |

FOREIGN PATENT DOCUMENTS

| | | | |
|---|---|---|---|
| 565152 | 10/1933 | Fed. Rep. of Germany | 55/136 |
| 445469 | 6/1975 | U.S.S.R. | 55/112 |

*Primary Examiner*—Kathleen J. Prunner
*Attorney, Agent, or Firm*—Arthur L. Nelson

[57] ABSTRACT

An electrode rapping arrangement for cleaning the collecting electrodes of a pair of serially aligned electrode assemblies in an electrostatic precipitator. The rapping arrangement includes a shaft extending horizontally across the interior of the precipitator between the electrode assemblies, and a crank mounted on the shaft between each of the opposing serially aligned electrodes of the electrode assemblies. An articulated linkage is pivotally secured to each of the cranks so as to swing a hammer mounted on the end of the linkage into an associated electrode on one of the electrode assemblies when the shaft is rotated in one direction and into an opposing electrode on the other electrode assembly when the shaft is rotated in the opposite direction.

9 Claims, 6 Drawing Figures

ELECTRODE RAPPING ARRANGEMENT

BACKGROUND OF THE INVENTION

1. Field of Invention

The present invention relates to gas separation devices and in particular to an electrode cleaning arrangement for an electrostatic precipitator.

2. Description of the Prior Art

The prior art includes a variety of cleaning devices for cleaning the electrodes of electrostatic precipitators. For example, U.S. Pat. No. 3,570,217 shows a rapping device for an electrostatic precipitator where a free-falling hammer alternately strikes two sides of a triangularly-shaped anvil mounted on the supporting framework of an electrode assembly to produce vibrations for dislodging accumulated particulates from the discharge electrodes of the precipitator. Similarly, U.S. Pat. No. 3,427,787 discloses a cleaning arrangement wherein a plurality of free-falling hammers are mounted on a rotating shaft extending across the interior of a precipitator which sequentially rap or vibrate the carriers on beams supporting the ionizing wires provided in that arrangement. Although it is not discussed in the foregoing patents, in large precipitator installations it has generally been necessary to rap the electrodes on a sectionalized basis to insure that each of the electrodes is individually rapped or vibrated. In such installations, a plurality of individually rapped electrode assemblies are arranged in series within the precipitator. While this type of arrangement has been generally satisfactory, it requires an individual rapping system for each of the electrode assemblies. This necessarily adds to the size and complexity of the installation as well as the cost of maintaining the system in the field.

SUMMARY OF THE INVENTION

The present invention relates to gas separation devices and in particular to an electrode rapping arrangement for cleaning opposing electrode assemblies in an electrostatic precipitator having at least two serially aligned electrode assemblies mounted within the flow-through housing of the precipitator.

In the electrostatic precipitator utilizing the rapping arrangement embodying the invention, each of the electrode assemblies includes a plurality of parallel walls or curtains providing the collecting electrodes of the precipitator. Each of the walls is aligned with a corresponding wall in the other electrode assembly and is formed of a plurality of serially aligned electrode plates or panels which are pivotally suspended from a common upper support and interconnected at their bases by a common lower retaining member which accommodates relative lateral movement between the edges of the adjacent panels of the wall.

The rapping arrangement includes a rotatable shaft extending horizontally across the interior of the housing between the opposing electrode assemblies equidistant from a pair of anvils mounted on the opposing ends of the lower retaining members. The shaft has a separate crank mounted on it in alignment in a plane with each of the anvils, and each of the cranks has an articulated linkage secured to it which is adapted to swing a hammer mounted on the end of each linkage into a corresponding anvil to vibrate or rap the electrode plates. During rapping operations, the shaft is rotated by a suitable rotary drive to rotate the cranks which in turn draw each of the linkages into a position overlying the shaft. Upon continued rotation of the shaft, each of the linkages guide their respective hammers into a hook formed in each of the cranks which retain the hammers until the cranks are rotated into a position where the hammers can fall free of the hooks. When this occurs, the hammers swing downwardly on the linkages into the anvils of one of the electrode assemblies when the shaft is rotated in one direction, and into the anvils of the other opposing electrode assembly when the shaft is rotated in the other direction.

From the foregoing, it can be seen that the invention contemplates a relatively straightforward and compact rapping arrangement which allows the electrode assemblies to be positioned closer together. This allows the use of a smaller precipitator housing while also reducing the cost and complexity of the arrangement over those heretofore in use. In this regard, it is to be understood that various changes can be made in the arrangement, form, and scope of the present disclosure without departing from the spirit and scope of the invention.

DESCRIPTION OF THE PREFERRED EMBODIMENT

Figure 1:
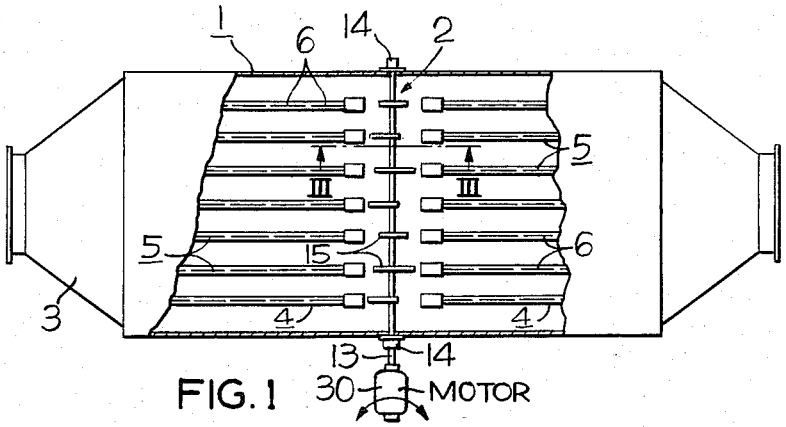
FIG. 1 is a top plan sectional view of an electrostatic precipitator incorporating the invention.
Figure 2:
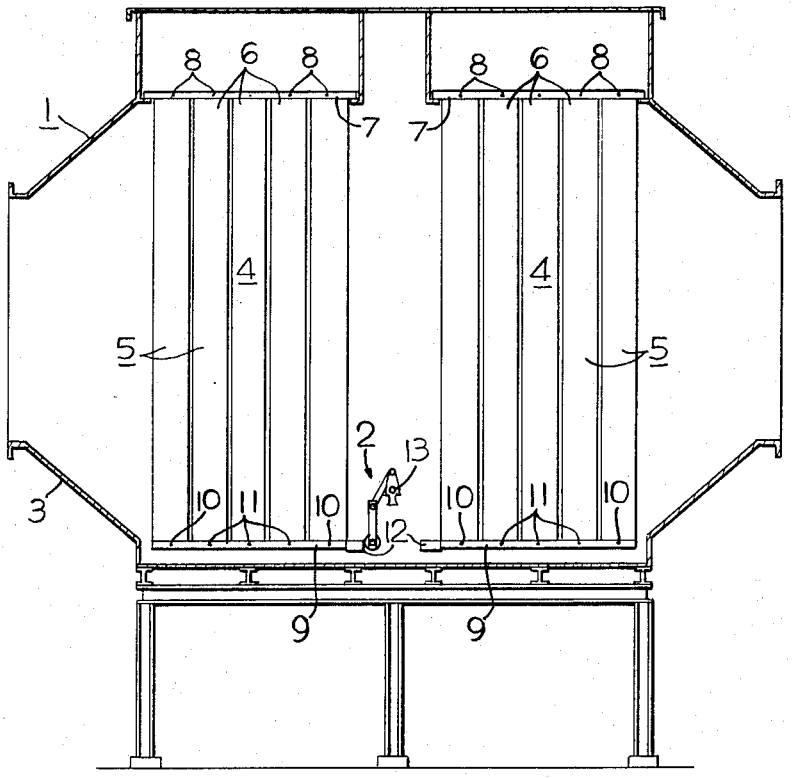
FIG. 2 is a side sectional elevational view of the precipitator shown in FIG. 1.

As shown in FIGS. 1 and 2, the electrostatic precipitator 1 incorporating the rapping arrangement 2 embodying the invention includes a flow-through housing 3 having a pair of serially aligned, spaced electrode assemblies 4 mounted within the housing. Each of the electrode assemblies 4 has a plurality of transversely spaced walls or curtains forming the collecting electrodes 5 of the precipitator which extend parallel to the direction of the gas flow through the precipitator. As discussed in the assignee's U.S. Pat. No. 4,240,810, each of the collecting electrodes 5 includes a series of successively aligned plates or panels 6 suspended from a pair of upper support beams 7 supported by the precipitator housing 3 on pins 8 pivotally connecting the upper ends of the panels to the upper beams as shown in FIG. 2. The lower ends of the panels 6 are similarly contained and positioned between a pair of lower beams 9. The outermost panels are pivotally connected to the lower beams by pins 10 and the remaining intermediate panels are retained in position by pins or stops 11 extending between the lower beams. Additionally, a block or anvil 12 is affixed to the end of each of the lower beams proximate the rapping arrangement 2.

The rapping arrangement 2 includes a rotatable shaft 13 extending horizontally across the interior of the housing 3 between the opposing electrode assemblies 4. As shown in the drawings, the shaft 13 is positioned equidistant from the anvils 12 of the opposing electrode assemblies 4 and its ends project through the walls of the housing 3 where they are supported by conventional bearings 14 mounted on the walls of the housing.

Figure 3:
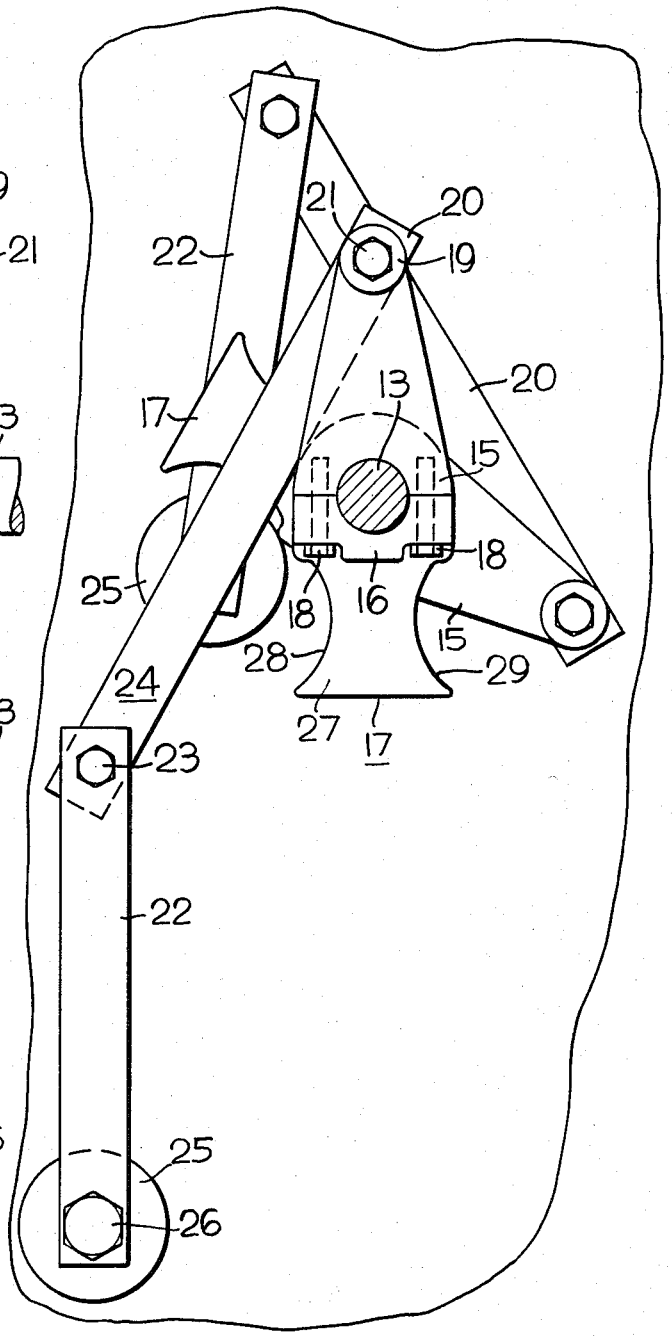
FIG. 3 is an enlarged side elevational view taken along line III—III in FIG. 1.

The shaft 13 has a plurality of cranks 15 mounted on it so that a separate crank 15 is positioned, in a plane in alignment with each of the opposing anvils 12 of the two electrode assemblies. In this regard, it should be noted that the cranks 15 are staggered about the radius of the shaft 13 as best shown in FIG. 3 so that only a portion of the collecting electrodes 5 will be rapped at any one time during cleaning operations.

Figure 4:
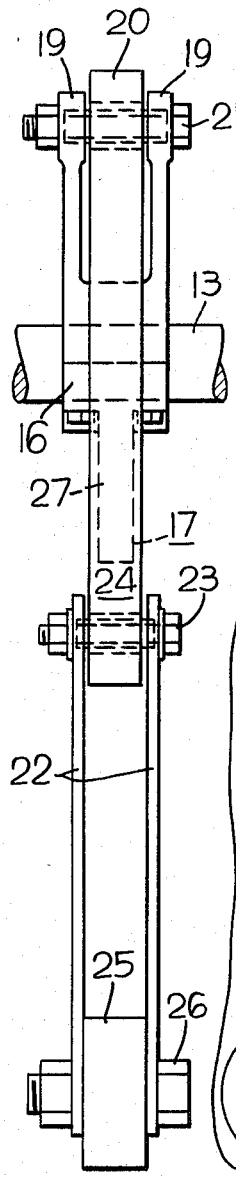
FIG. 4 is an edge elevational view of the rapping arrangement shown in FIG. 3.

Each of the cranks 15 is of a two-piece construction including an attachment portion 16 and a hook portion 17 which allows a workman to readily secure the crank to the shaft by assembling the two parts about the shaft 13 and then securing them together with bolts 18 to clamp the shaft between them. As shown in FIGS. 3 and 4, the attachment portion 16 is a clevis-like member having a pair of ears 19 spaced apart to receive the end of an elongated bar or first arm 20 which is pivotally secured to the ears 19 by a bolt assembly 21. The other end of the first arm 20 is similarly pivotally secured to one end of a pair of bars or second arms 22 by a second bolt assembly 23 to form an articulated linkage 24 having a roller 25 serving as a hammer for the device secured by a third bolt assembly 26 to the other end of the second arms 22. The hook portion 17 includes a single plate 27 projecting from the shaft 13 which has opposing notches 28 and 29 cut in the sides of the plate 27. The notches 28 and 29 form hooks in the plate 27 which are sized to receive and retain the roller 25 as will be described. In the embodiment shown, the thickness of the plate 27 is less than the spacing between the second arms 22 to allow the roller 25 to move freely into the notches 28 and 29 without any interference between the second arms and the plate.

During a normal cleaning cycle, the invention calls for first rotating the shaft in one direction to rap the electrodes in one of the electrode assemblies and then rotating the shaft in the opposite direction to rap the electrodes in the opposing electrode assembly. In the preferred embodiment, the shaft is rotated by a reversible electric drive motor 30 which can be any one of a variety of commercially available motors currently in use.

Figure 6:
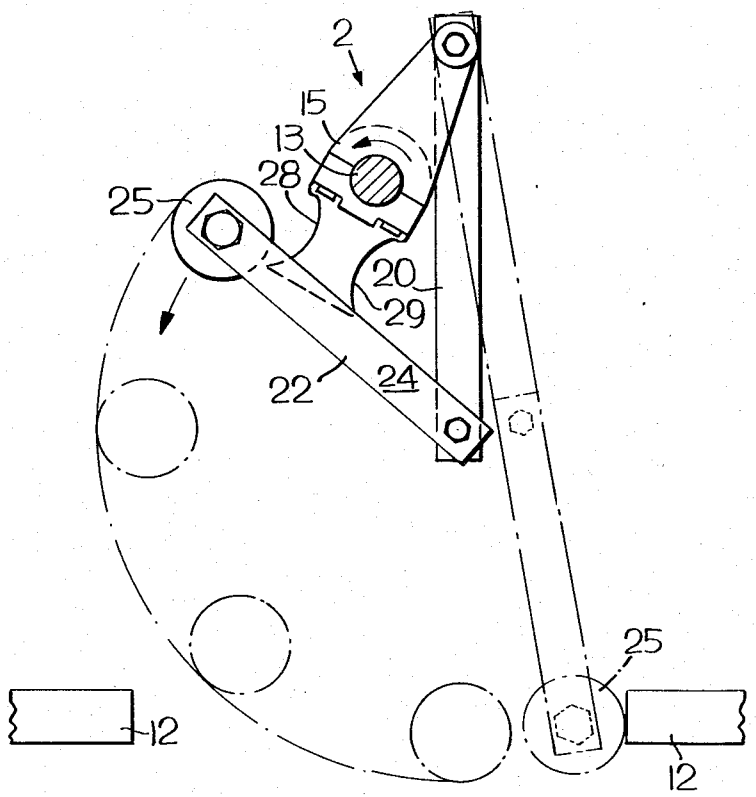
FIGS. 5 and 6 are schematic views showing the progression of the rapping arrangement during a typical rapping cycle.
Figure 5:
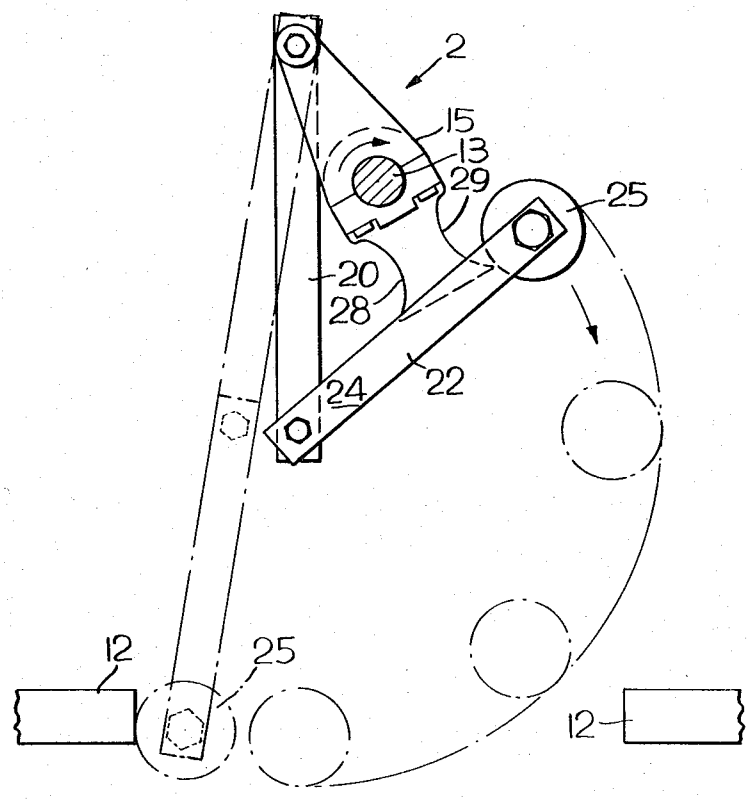

Referring to FIGS. 5 and 6, those drawings illustrate a normal operating cycle of the rapping arrangement 2. Assuming the shaft 13 is initially rotated in a clockwise direction as shown in FIG. 5, each of the cranks 15 draws its associated first arm 20 into a position overlying the shaft 13. Thereafter, continued rotation of the shaft 13 causes the first arms 20 to lift the second arms 22 in a fashion guiding the rollers 25 into the notches 29. Then, as the shaft 13 continues to rotate, the cranks 15 are moved into a position where the rollers 25 can fall free of the notches 29. When this occurs, the rollers 25 swing downwardly on the linkages 24 into the anvils 12 to rap the electrodes in the electrode assembly shown on the left-hand side of FIG. 2. Thereafter, the electrodes of the opposing electrode assembly 4 shown on the right-hand side of FIG. 2 can be rapped by rotating the shaft 13 in a counterclockwise direction as shown in FIG. 6. The operating cycle for that case is essentially the same as when the crank is rotated in a clockwise direction except when the shaft 13 is rotated in a counterclockwise direction the rollers 25 are guided into the notches 28 instead of the notches 29.

The embodiments of the invention in which an exclusive property or privilege is claimed are defined as follows:

1. In an electrostatic precipitator having a flow-through housing and a pair of spaced opposing electrode assemblies with each assembly including a plurality of electrodes and an anvil connected with each of the electrodes aligned with anvils of the opposing electrode assembly, the improvement comprising an electrode rapping arrangement including:

a rotatably supported shaft extending horizontally across the interior of the housing between the opposing electrode assemblies equidistant from each of the assemblies;

drive means for rotating said shaft in either direction;

a crank mounted on the shaft aligned in a plane with each of the anvils;

said crank having an attachment portion and an outwardly opening hook portion;

an articulated linkage including a first arm having one end pivotally secured to said attachment portion and a second arm having one end pivotally secured to the other end of said first arm;

a hammer affixed to the other end of said second arm; and said first and second arms defining lengths whereby rotation of the shaft in either direction causes the crank to draw the first arm into a position overlying the shaft and continued rotation of the shaft causes the first arm to lift the second arm in a fashion guiding the hammer into the hook portion of the crank which releases the hammer upon continued rotation of the shaft to allow the hammer to swing downwardly on the linkage into the anvil on one of the opposing electrode assemblies when the shaft is rotated in one direction and the anvil on the other opposing electrode when the shaft is rotated in the other direction.

2. The electrode rapping arrangement of claim 1, and said first arm being formed of a single elongated bar and said second arm being formed of a pair of elongated bars having said first arm sandwiched therebetween; and said hook portion being sized to fit between the elongated bars of said second arm.

3. The electrode rapping arrangement of claim 2, and said hammer being a roller pivotally secured between the elongated bars of said second arm.

4. The electrode rapping arrangement of claim 3, and said attachment portion being a clevis-like member including a pair of spaced ears having said first arm pivotally secured therebetween.

5. The electrode rapping arrangement of claim 1, and said crank being releasably secured to said shaft.

6. The electrode rapping arrangement of claim 1, and said crank being mounted on the shaft with the shaft extending through the crank intermediate of its ends so its attachment portion projects from one side of the shaft and said hook portion projects from the other side of the shaft.

7. The electrode rapping arrangement of claim 1, and said crank being of a separable two-piece construction accommodating releasably securing the crank to the shaft.

8. The electrode rapping arrangement of claim 1, and said drive means including a motor coupled to the shaft for alternately rotating it in a clockwise and counterclockwise direction during rapping operations.

9. The electrode rapping arrangement of claim 1, and said electrodes, including a plurality of successively aligned vertical plates serially suspended within the housing.

* * * * *